US008821184B2

(12) United States Patent
Yu et al.

(10) Patent No.: US 8,821,184 B2
(45) Date of Patent: Sep. 2, 2014

(54) POWER CONNECTOR FOR TRANSMITTING HIGH CURRENT

(71) Applicant: Alltop Electronics (Suzhou) Ltd., Taicang (CN)

(72) Inventors: Wang-I Yu, Jhonghe (TW); Hung-Chi Tai, Jhonghe (TW); Yung-Chi Hung, Jhonghe (TW)

(73) Assignee: Alltop Electronics (Suzhou) Ltd., Taicang (CN)

( * ) Notice: Subject to any disclaimer, the term of this patent is extended or adjusted under 35 U.S.C. 154(b) by 36 days.

(21) Appl. No.: 13/632,641

(22) Filed: Oct. 1, 2012

(65) Prior Publication Data

US 2014/0024267 A1 Jan. 23, 2014

(30) Foreign Application Priority Data

Jul. 17, 2012 (CN) ..... 2012 1 0246317

(51) Int. Cl.
*H01R 11/09* (2006.01)

(52) U.S. Cl.
USPC ..... 439/512; 439/626; 439/682

(58) Field of Classification Search
USPC ..... 439/626, 507, 682–697, 512
See application file for complete search history.

(56) References Cited

U.S. PATENT DOCUMENTS

| | | | | |
|---|---|---|---|---|
| 5,273,464 | A * | 12/1993 | Rushing | 439/723 |
| 7,153,157 | B2 * | 12/2006 | Robinson et al. | 439/508 |
| 7,168,989 | B2 * | 1/2007 | Faulkner | 439/620.22 |
| 7,232,335 | B2 * | 6/2007 | Preuhs et al. | 439/518 |
| 7,604,516 | B2 * | 10/2009 | Adunka et al. | 439/709 |
| 8,419,476 | B1 * | 4/2013 | Yu et al. | 439/626 |
| 8,419,477 | B1 * | 4/2013 | Yu et al. | 439/626 |
| 8,545,270 | B2 * | 10/2013 | Yu et al. | 439/626 |
| 8,574,015 | B2 * | 11/2013 | Tai et al. | 439/682 |

* cited by examiner

*Primary Examiner* — Gary Paumen
(74) *Attorney, Agent, or Firm* — Sughrue Mion, PLLC

(57) ABSTRACT

A power connector includes an insulative housing, a number of power contacts received in the insulative housing, a terminal contact assembled at a rear side of the insulative housing, a contact bus bar and a fastening member attached to the insulative housing. The contact bus bar and the fastening member connect the number of power contacts with the terminal contact.

19 Claims, 5 Drawing Sheets

POWER CONNECTOR FOR TRANSMITTING HIGH CURRENT

BACKGROUND OF THE INVENTION

1. Field of the Invention

The present invention relates to an electrical connector, more particularly to a power connector.

2. Description of Related Art

A conventional power connector usually includes a plurality of power contacts and a housing receiving the power contacts. Each power contact has a mating portion electrically connecting with a complementary connector and a soldering portion connecting with a printed circuit board or a terminal device. Generally, the rear portions and the soldering portions are provided correspondingly. In other words, each mating portion connects with a respective soldering portion. However, when the conventional power connector is used in an environment needing high electric current, the power contacts of such conventional power connector are easier to be invalid, which in turn make troubles for users.

Hence, it is necessary to provide the power connector with high current to resolve problems mentioned above.

BRIEF SUMMARY OF THE INVENTION

Accordingly, an object of the present invention is to provide a power connector for transmitting high current.

In order to achieve the above-mentioned object, a power connector in accordance with the present invention includes an insulative housing, a plurality of power contacts received in the insulative housing, a terminal contact assembled at a rear side of the insulative housing, a contact bus bar and a fastening member attached to the insulative housing. The contact bus bar and the fastening member connect the plurality of power contacts with the terminal contact.

In order to achieve the above-mentioned object, a power connector for transmitting high current is provided, which includes an insulative housing having a main portion defining a plurality of receiving holes extending therethrough, at least two power contacts received in corresponding receiving holes, a terminal contact electrically connecting with the at least two power contacts, a U-shaped contact bus bar mechanically and electrically connecting the terminal contact with the at least two power contacts, and a fastening device firmly fastening the terminal contact, the at least two power contacts and the U-shaped contact bus bar. Each power contact has a contacting pad extending along a first direction and a connecting pad extending from the contacting pad along a second direction different from the first direction.

The foregoing has outlined rather broadly the features and technical advantages of the present invention in order that the detailed description of the invention that follows may be better understood. Additional features and advantages of the invention will be described hereinafter, which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENTS

Figure 1:
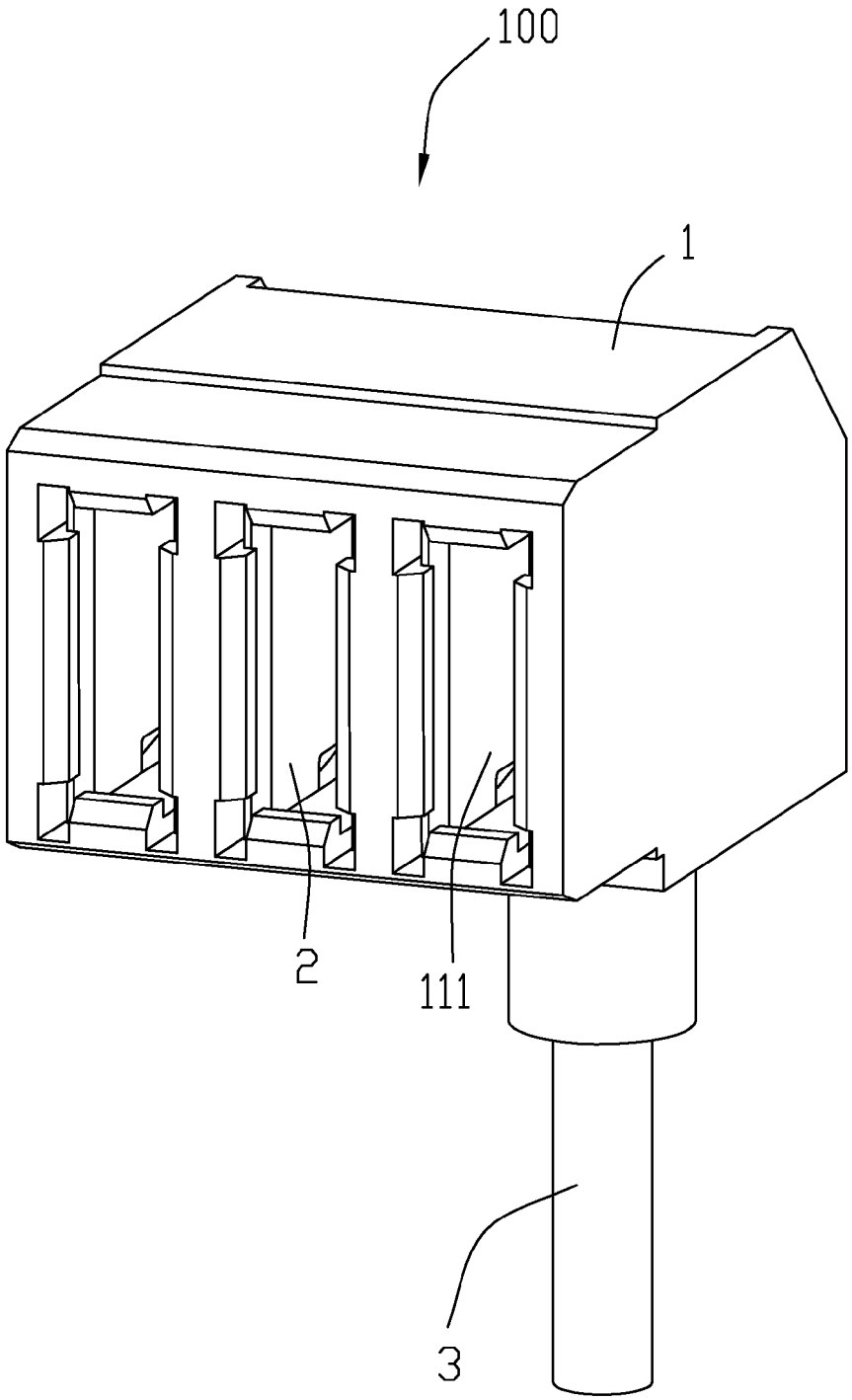
FIG. 1 is an assembled, perspective view of a power connector in accordance with the present invention.
Figure 2:
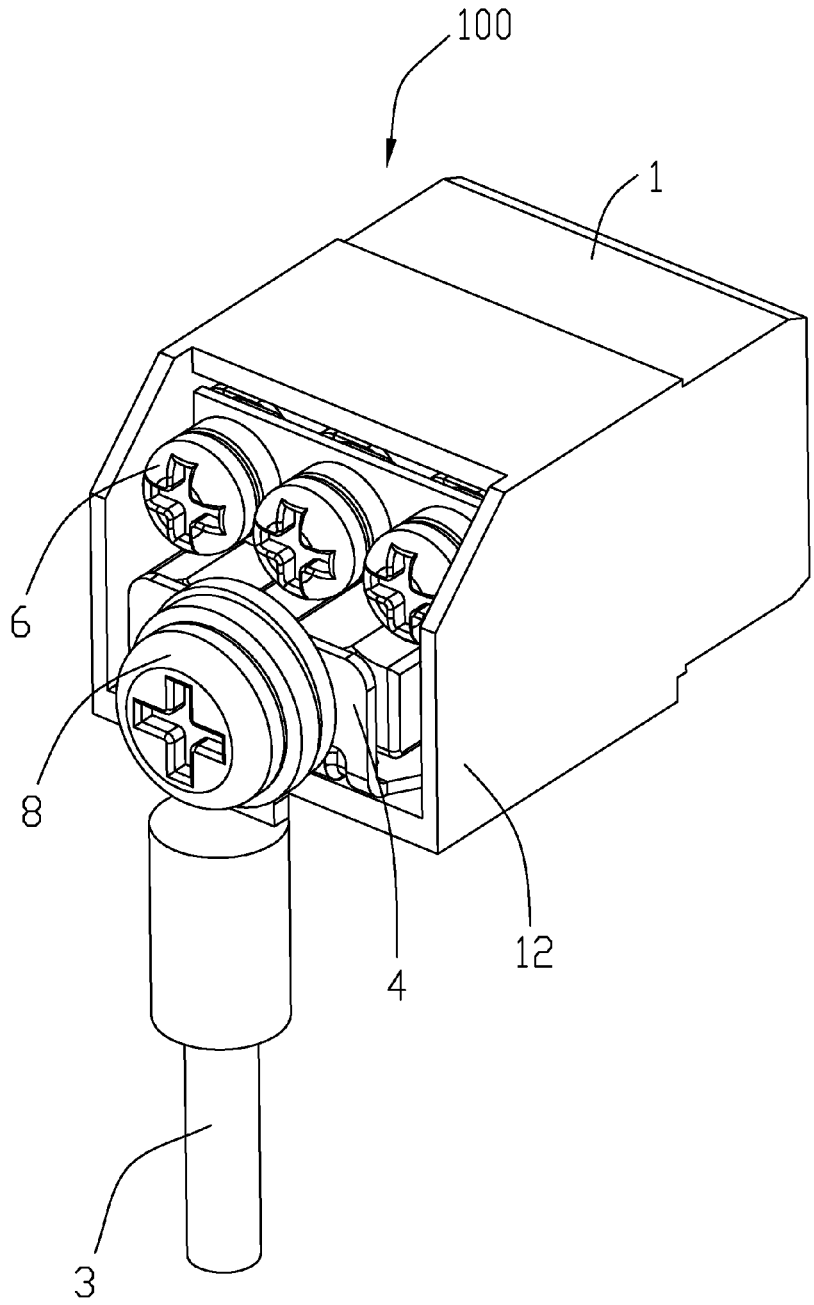
FIG. 2 is a view similar to FIG. 1, but from a different aspect.

In the following description, numerous specific details are set forth to provide a thorough understanding of the present invention. However, it will be obvious to those skilled in the art that the present invention may be practiced without such specific details. In other instances, well-known circuits have been shown in block diagram form in order not to obscure the present invention in unnecessary detail. For the most part, details concerning timing considerations and the like have been omitted inasmuch as such details are not necessary to obtain a complete understanding of the present invention and are within the skills of persons of ordinary skill in the relevant art.

Reference will be made to the drawing figures to describe the present invention in detail, wherein depicted elements are not necessarily shown to scale and wherein like or similar elements are designated by same or similar reference numeral through the several views and same or similar terminology.

Please refer to FIGS. 1-5, an electrical connector 100 in accordance with the present invention comprises an insulative housing 1, a plurality of power contacts 2 accommodated in the insulative housing 1, a terminal contact 3 assembled at a rear side of the insulative housing 1, a contact bus bar 4 and a fastening member 5 mechanically and electrically connecting the power contacts 2 with the terminal contact 3.

Figure 3:
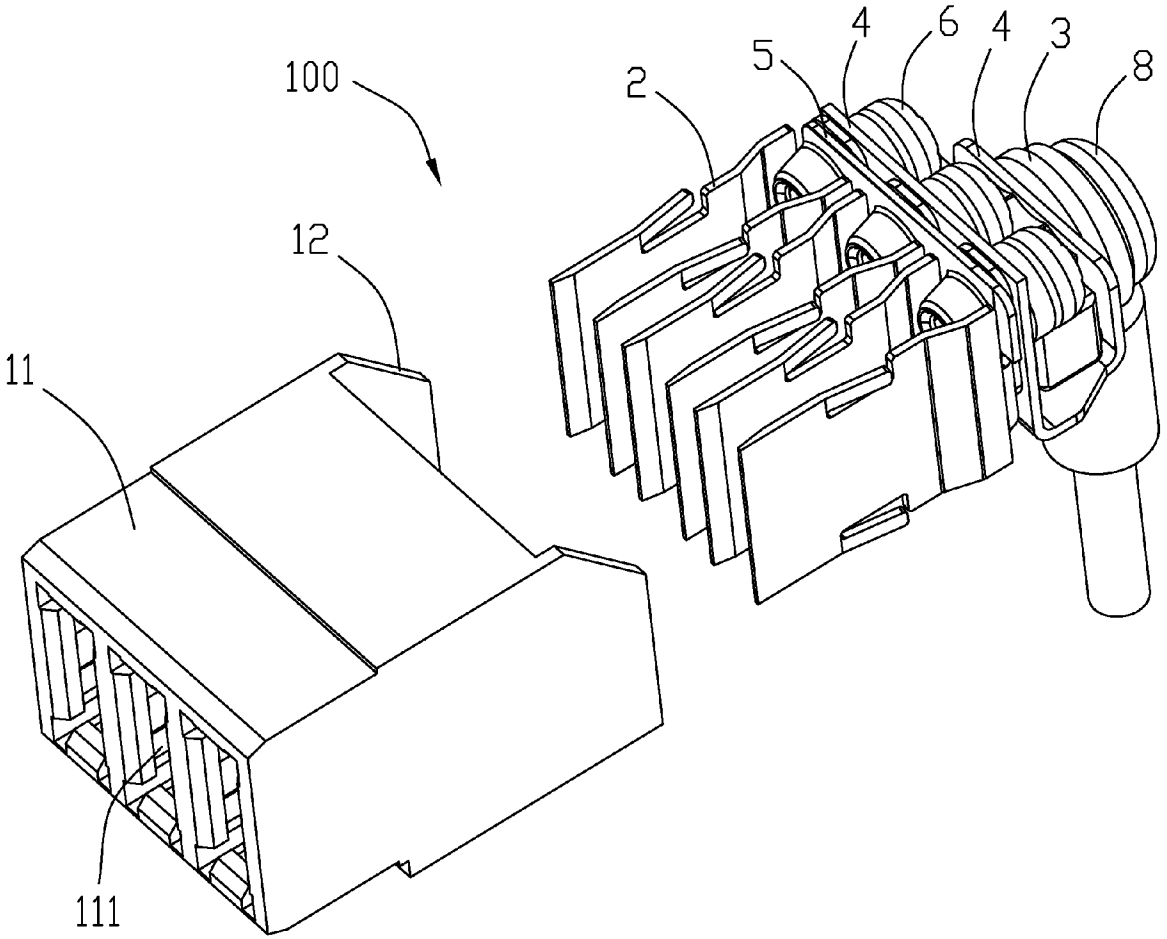
FIG. 3 is a partially exploded, perspective view of the power connector in accordance with the present invention.
Figure 4:
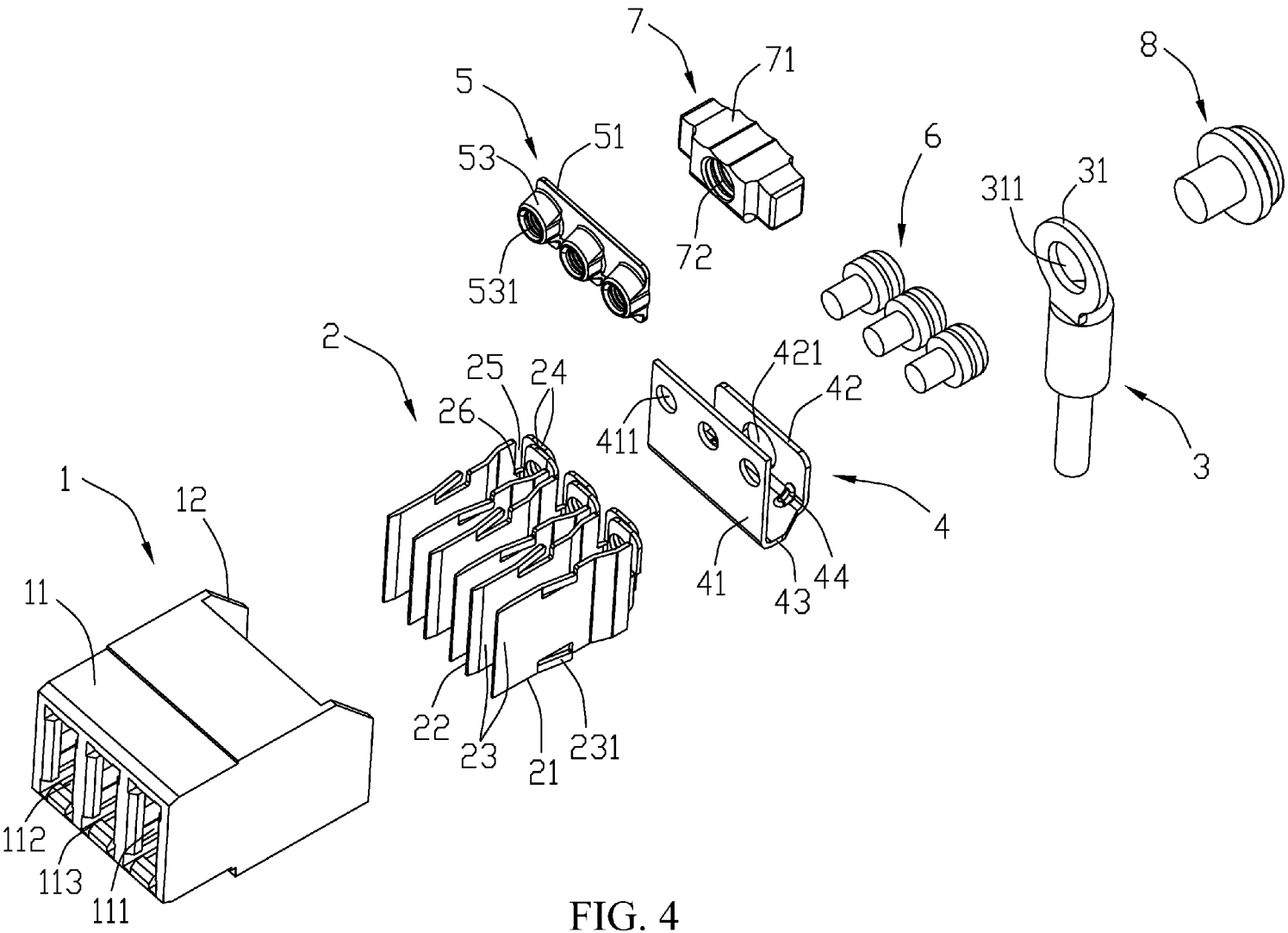
FIG. 4 is an exploded, perspective view of the power connector.
Figure 5:
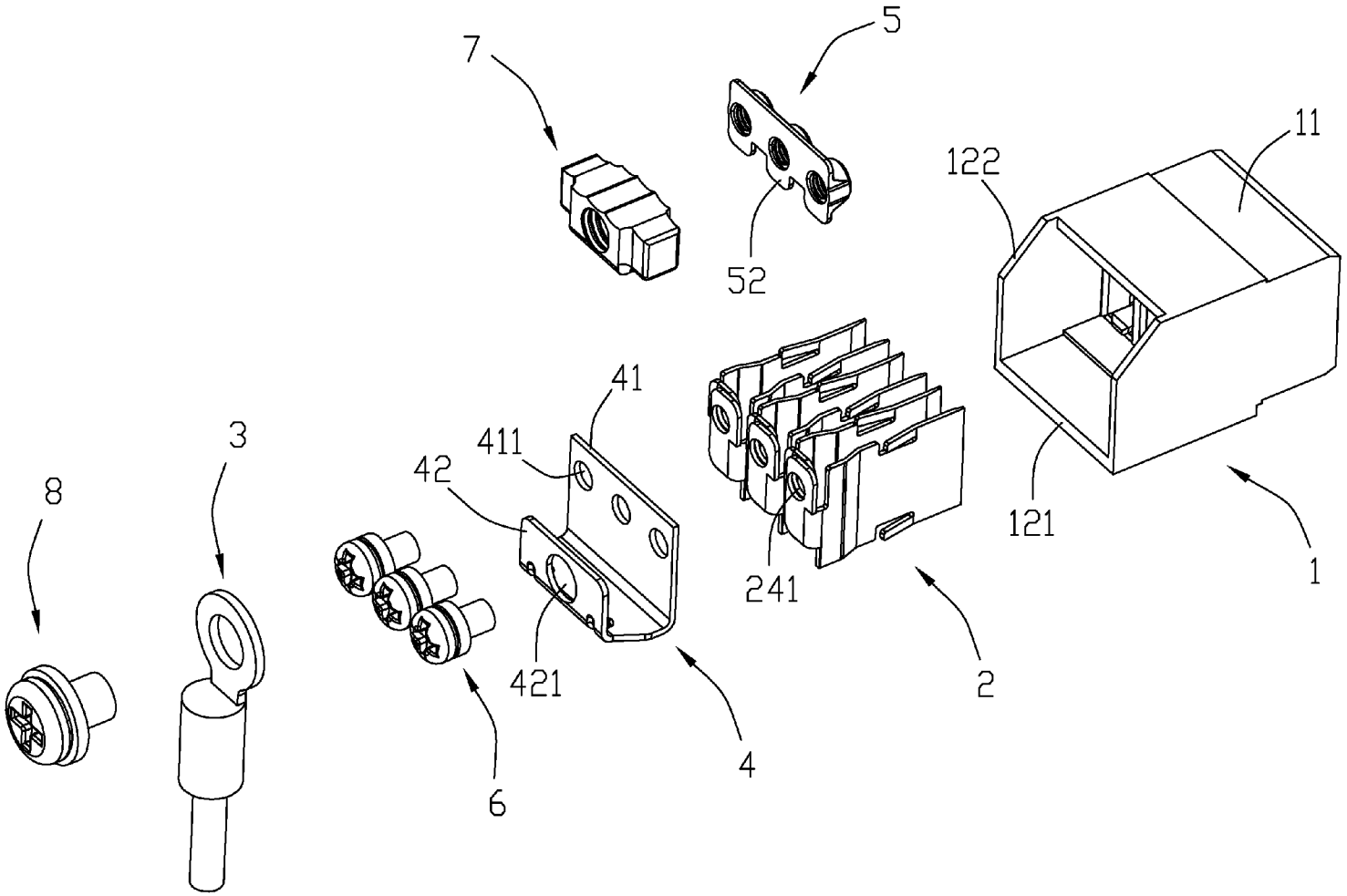
FIG. 5 is a view similar to FIG. 4, but from a different view.

Please refer together to FIGS. 3-5, the insulative housing 1 comprises a main portion 11 and a rear portion 12 extending rearwardly from the main portion 11 along an insertion direction of a complementary connector (not shown). The main portion 11 defines a plurality of receiving holes 111 along a front-to-back direction. In the preferred embodiment, there are three receiving holes 111. The receiving holes 111 are arranged side by side along a width direction of the power connector 100. The receiving holes 111 include an engaging hole 112 and a pair of contact receiving holes 113 located at opposite sides of the engaging hole 112. The rear portion 12 has a substantial U-shaped configuration and comprises a bottom wall 121 and a pair of side walls 122 extending from opposite edges of the bottom wall 121.

Please refer to FIGS. 1-5, each power contact 2 includes a first contact 21 and a second contact 22 opposite to the first contact 21. Both the first contact 21 and the second contact 22 comprise a contacting pad 23 confronting to each other and a connecting pad 24 extending from a rear edge of the contacting pad 23. The contacting pads 23 of the first contact 21 and the second contact 22 are received in corresponding contact receiving holes 113. The power contact 2 defines a plurality of tabs 231 formed on the contacting pads 23. The plurality of tabs 231 are adapted to secure the power contacts 2 in the insulative housing 1 and limit a front-to-back movement of the power contact 2. The power contact 2 defines a cutout 25 located between the contacting pad 23 and the connecting pad 24. The cutout 25 opens upwards for receiving corresponding fastening member 5. Each power contact 2 defines a positioning slot 26 between the contacting pads 23 of the first and the second contacts 21, 22, and in front of the connecting pads 24. The connecting pads 24 of the first and the second contacts 21, 22 are overlapped. Each connecting pad 24 defines a positioning hole 241 located at a rear side of the receiving hole 111 and exposed at the rear portion 12.

Please refer to FIGS. 3-5, the fastening member 5 is arranged with the power contacts 2. In the preferred embodiment, the fastening member 5 is a nut. The fastening member 5 comprises a main plate 51, a plurality of tabs 52 extending downwardly from a lower edge of the main plate 51, and a plurality of projections 53 projecting forwardly from the main plate 51. Each projection 53 defines a through hole 531 extending therethrough, which is a screw hole. The main plate 51 is partially positioned in the cutouts 25 to thereby secure the fastening member 5 along the front-to-back direction. The tabs 52 extend and are received in the corresponding positioning slots 26 of the power contacts 2. The screw hole 531 of the projection 53 communicates with corresponding positioning hole 241 of the power contact 2.

Referring to FIGS. 2-5, the contact bus bar 4 is assembled to the U-shaped rear portion 12 of the insulative housing 1. The contact bus bar 4 includes a first side wall 41 connecting with the power contacts 2, a second side wall 42 opposite to the first side wall 41 and a bottom side wall 43 interconnecting the first side all 41 with the second side wall 42. The first side wall 41 is parallel to and is higher than the second side wall 42. The contact bus bar 4 defines a plurality of through holes 411 extending through the first side wall 41 and a secure hole 421 through the second side wall 42. The through hole 411 of the contact bus bar 4, the positioning hole 241 of the power contact 2, and the screw hole 531 of the fastening member 5 are communicating with each other along a back-to-front direction. The bottom side wall 43 is located on the bottom wall 121 of the rear portion 12.

Please refer to FIGS. 2-5, the power connector 100 comprises a plurality of locking elements 6. In the preferred embodiment, the locking element 6 is a screw which is able to engage with the fastening member 5. The locking element 6 extends successively through the through hole 411 of the contact bus bar 4 and the positioning hole 241 of the power contact 2, and finally screws within the screw hole 531 of the fastening member 5. In other words, the connecting pad 24 of the power contact 2 is sandwiched between the fastening member 5 and the contact bus bar 4.

Together referring to FIGS. 2-5, the terminal contact 3 is housed at a rear side of the contact bus bar 4. The terminal contact 3 includes a connecting portion 31 which defines a fastening hole 311 therethrough for communicating with the secure hole 421 of the contact bus bar 4.

Together referring to FIGS. 3-5, the power connector 100 includes a positioning nut 7 located between the first side wall 41 and the second side wall 42 of the contact bus bar 4. The positioning nut 7 is firmly arranged through the positioning protrusions 44 formed on the contact bus bar 4. Understandably, the positioning protrusions 44 can be either strip shape or a bump shape. The positioning nut 7 provides a plurality of grooves 71 on a top side thereof for helping to position the locking elements 6 correspondingly. The positioning nut 7 is formed in symmetric structure and provides a screw hole 72 communicating with corresponding secure hole 421 and the fastening hole 311.

Together referring to FIGS. 2-5, the power connector 100 also includes a fastening screw 8 extending successively and engaging within the fastening hole 311 of the terminal contact 3, the secure hole 421 of the contact bus bar 4, and finally the screw hole 72 of the positioning nut 7.

As a whole, firstly, the power contacts 2 are connected in parallel; then, the parallel power contacts 2 connects with the terminal contact 3 in series through the contact bus bar 4. That is, the current in the terminal contact 3 is equal to the total current through the three power contacts 2. Hence, the present invention can be used in the condition needing high current. It is also stable for transmitting high current.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed. For example, the tongue portion is extended in its length or is arranged on a reverse side thereof opposite to the supporting side with other contacts but still holding the contacts with an arrangement indicated by the broad general meaning of the terms in which the appended claims are expressed.

We claim:

1. A power connector, comprising:

an insulative housing;

a plurality of power contacts received in the insulative housing;

a terminal contact assembled at a rear side of the insulative housing; and a contact bus bar and a fastening element; wherein the contact bus bar and the fastening element connect the plurality of power contacts with the terminal contact;

wherein both the contact bus bar and the fastening element define therethrough a plurality of through holes, respectively.

2. The power connector as claimed in claim 1, further comprising a plurality of locking elements, and wherein the locking elements extend through the corresponding through holes of the contact bus bar and the fastening element to thereby securely connect the power contacts and the terminal contact.

3. The power connector as claimed in claim 2, wherein the through hole of the fastening element is a screw hole and the locking element is a screw.

4. The power connector as claimed in claim 3, wherein the contact bus bar comprises a first side wall contacting with the power contacts and a second side wall opposite to the first side wall, wherein the through holes are defined through the first side wall, and wherein the second side wall defines a secure hole.

5. The power connector as claimed in claim 4, wherein the first side wall and the second side wall extend parallel to each other along a height direction of the power connector, and wherein the first side wall is higher than the second side wall.

6. The power connector as claimed in claim 4, further comprising a positioning nut, which is located between the first side wall and the second side wall.

7. The power connector as claimed in claim 6, wherein the positioning nut defines a plurality of grooves on a top side thereof, and wherein the groove is provided to engage and position the corresponding locking element.

8. The power connector as claimed in claim 6, wherein the contact bus bar defines a plurality of positioning protrusions adapted for locating the positioning nut between the first side wall and the side wall.

9. The power connector as claimed in claim 6, wherein the positioning nut is formed in symmetric structure.

10. The power connector as claimed in claim 6, wherein the positioning nut provides a screw hole communicating with the secure hole and wherein the terminal contact defines a fastening hole communicating with the secure hole and the screw hole.

11. The power connector as claimed in claim 10, further comprising a fastening screw extending respectively through the fastening hole and the secure hole to thereby lock with the screw hole.

12. The power connector as claimed in claim 3, wherein the fastening element provides a projection extending along a front-to-back direction, and wherein the screw hole of the fastening element is defined in the projection.

13. The power connector as claimed in claim 12, wherein the fastening element comprises a plurality of tabs extending downwardly therefrom, and wherein the power contact defines a positioning slot engaging corresponding tab to thereby position the fastening element with the power contact.

14. A power connector for transmitting high current, comprising:

an insulative housing having a main portion defining a plurality of receiving holes extending therethrough;

at least two power contacts received in corresponding receiving holes, each of the at least two power contacts having a contacting pad extending along a first direction and a connecting pad extending from the contacting pad along a second direction different from the first direction;

a terminal contact electrically connecting with the at least two power contacts;

a U-shaped contact bus bar mechanically and electrically connecting the terminal contact with the at least two power contacts;

a fastening device firmly fastening the terminal contact, the at least two power contacts and the U-shaped contact bus bar.

15. The power connector for transmitting high current as claimed in claim 14, wherein the fastening device includes a fastening element, a positioning nut and at least two locking elements.

16. The power connector for transmitting high current as claimed in claim 15, wherein each of the at least two power contact provides a positioning slot for partially engaging the fastening element.

17. The power connector for transmitting high current as claimed in claim 16, wherein each of the at least two power contact is composed by a first contact and a second contact opposite to the first contact with the two connecting pads thereof overlapped with each other.

18. The power connector for transmitting high current as claimed in claim 15, wherein the connecting pads of the at least two power contacts are sandwiched between the fastening element and the contact bus bar.

19. The power connector for transmitting high current as claimed in claim 15, wherein the at least two locking elements are screws.

* * * * *